US005433052A

United States Patent [19]

Niese

[11] Patent Number: 5,433,052

[45] Date of Patent: Jul. 18, 1995

[54] KERFED HARDWOOD FLOOR SYSTEM

[75] Inventor: Michael W. Niese, Cincinnati, Ohio

[73] Assignee: Robbins, Inc., Cincinnati, Ohio

[21] Appl. No.: 844,466

[22] Filed: Mar. 2, 1992

Related U.S. Application Data

[63] Continuation-in-part of Ser. No. 769,157, Sep. 27, 1991, which is a continuation of Ser. No. 459,198, Dec. 29, 1989, which is a continuation-in-part of Ser. No. 308,243, Feb. 8, 1989, Pat. No. 4,890,434.

[51] Int. Cl.[6] ..... E04B 1/62

[52] U.S. Cl. ..... 52/403.1; 52/480

[58] Field of Search ..... 52/393, 403, 390, 408, 52/480

[56] References Cited

U.S. PATENT DOCUMENTS

| | | | |
|---|---|---|---|
| 1,477,331 | 12/1923 | Ely . | |
| 2,088,238 | 7/1937 | Greenway . | |
| 2,477,071 | 7/1949 | Matti et al. . | |
| 2,569,709 | 10/1951 | Elmendorf . | |
| 2,634,464 | 4/1953 | Storm et al. . | |
| 2,661,511 | 12/1953 | Weyerhaeuser . | |
| 2,893,665 | 7/1959 | Paulsen . | |
| 2,919,476 | 8/1956 | Fritz . | |
| 3,107,377 | 10/1963 | Nathan . | |
| 3,273,296 | 9/1966 | Soulon . | |
| 3,279,138 | 12/1961 | Dittmar . | |
| 3,288,405 | 11/1966 | Johnson . | |
| 3,337,167 | 8/1967 | Johnson . | |
| 3,368,806 | 2/1968 | Szonn . | |
| 3,417,950 | 12/1968 | Johnson . | |
| 3,579,410 | 5/1971 | Barrett . | |
| 3,579,941 | 5/1971 | Tibbals . | |
| 3,908,053 | 9/1975 | Hettich | 52/390 X |
| 4,682,459 | 7/1987 | Stephenson | 52/393 X |
| 4,879,857 | 11/1989 | Peterson et al. . | |

FOREIGN PATENT DOCUMENTS

| | | |
|---|---|---|
| 240020 | 5/1965 | Austria . |
| 485372 | 8/1952 | Canada . |
| 565012 | 10/1958 | Canada . |
| 675982 | 12/1963 | Canada . |
| 1157367 | 11/1960 | Germany . |
| 1255900 | 7/1967 | Germany . |
| 2053588 | 5/1972 | Germany . |
| 2221761 | 11/1973 | Germany . |
| 2609792 | 9/1977 | Germany . |
| 427830 | 11/1947 | Italy . |
| 557430 | 2/1957 | Italy . |
| 353158 | 5/1955 | Switzerland . |
| 835758 | 5/1960 | United Kingdom . |

*Primary Examiner*—Carl D. Friedman
*Assistant Examiner*—Creighton Smith
*Attorney, Agent, or Firm*—Wood, Herron & Evans

[57] ABSTRACT

A hardwood floor system has upper and lower subfloors of wooden panels, a plurality of elongated floorboards disposed above the upper subfloor and a plurality of uniformly spaced compressible, deflectable pads supporting the lower subfloor above a base, with at least one kerfed surface in the group of surfaces including the floorboard bottom surface, the upper subfloor surfaces, and the lower subfloor surfaces. In a free-floating embodiment of the invention, each of the pads includes a glide tip that is slidable with respect to the base. This combination of kerfs and compressible, deflectable pads provides a hardwood floor system that substantially complies with the performance characteristics established by the Otto Graf Institut of West Germany for evaluating hardwood floor systems, but in a more economical manner than another embodiment of the invention described in the parent application.

18 Claims, 6 Drawing Sheets

KERFED HARDWOOD FLOOR SYSTEM

This is a continuation-in-part application of application, Ser. No. 769,157, filed on Sep. 27, 1991 and entitled "Kerfed Hardwood Floor System", which is a continuation of application Ser. No. 459,198, filed on Dec. 29, 1989 and entitled "Kerfed Hardwood Floor System", which is a continuation-in-part application of application Ser. No. 308,243, filed on Feb. 8, 1989 and issued on Jan. 2, 1990 as U.S. Pat. No. 4,890,434, entitled "Hardwood Floor System".

FIELD OF THE INVENTION

This invention relates to hardwood floor systems.

BACKGROUND OF THE INVENTION

The preferred embodiment of the parent application was particularly adapted to meeting the strict performance requirements set forth by The Otto Graf Institut of Stuttgart, West Germany in a test referred to as DIN #18032, part 2 (hereinafter referred to as "the DIN test"). The high standards established by the DIN test are particularly desirable for certain sports, such as basketball, where each of the performance characteristics has a direct effect on either the reduction of impact related injuries or the nature of the game itself.

It is also highly desirable to provide a hardwood floor system which adequately addresses each of the performance characteristics of the DIN test, but due to the nature of use for the floor system, does not require strict adherence to all of the criteria established by the DIN test. For instance, sports such as aerobics, volleyball, racquet ball, squash and handball would be in this category. It is also desirable to provide a floor system which substantially meets most of the performance characteristics of the DIN test, but which is less expensive than the floor system described and claimed in the parent application.

In the parent application, it was pointed out that in the development of athletic floor systems, particularly hardwood floor systems, it is desirable to reduce the occurrence of injuries caused by the interaction with the floor and to provide a surface with highly consistent performance characteristics during competition. While certain gains have been made toward these ends, further improvements are still desirable. In order to measure the ability of a floor system to meet the desired characteristics of reduced injury and consistent performance, the Otto Graf Institut of Stuttgart, West Germany has established a set of standards or requirements for hardwood floor systems.

Hardwood floor systems have been generally preferred over other playing surfaces because wood wears slowly and uniformly, provides long functional service, possesses natural warmth, beauty and resilience characteristics with only modest maintenance costs. A typical hardwood floor system is laid on a base such as a concrete or asphalt slab, or a pre-existing floor. An intermediate support means or layer is secured to the base. A top layer of hardwood maple floorboards is secured to the support surface and forms the actual playing surface. Another type of athletic flooring system which is not secured to the base, is referred to as a free-floating floor. In such a floor, the top hardwood floor board layer and intermediate layer float freely with respect to the base. A layer of filler made of a foam or cushion material may reside between the base and the intermediate support layer and/or between the top layer and the intermediate layer.

The supporting layer or layers residing beneath the maple floorboards maintain the relative positions of the floorboards in a set position, withstanding movement due to moisture changes in the wood, or flexing action of the floor. In order to reduce the occurrence of injury during use of the floor, the supporting layer must also provide a desired degree of shock absorption and resiliency, or give, so that upon impact, the floor system will reduce the amount of force that is imparted by the floor system upon the impacting object.

In order to reduce this force, a hardwood floor system must deflect downwardly and absorb a degree of energy upon impact. Moreover, as the amount of downward deflection built into the floor system increases or as the stopping distance of the impacting object increases, the amount of force that can be absorbed also increases. Thus, for a hardwood athletic floor system, in order to reduce the likelihood of athletic injury resulting from impact with the floor, it is desirable to increase the vertical deflectability of the floor surface.

At the same time, while downward deflectability is desirable, hardwood athletic floors must also possess certain qualities which, by their nature, restrain or limit the amount of deflectability that is attainable. For instance, a hardwood floor system must have some degree of firmness, in order to provide at least a minimum accepted level of ball reflection and foot stability. Otherwise, for sports such as basketball, the entire complexion of the game would be drastically changed.

Moreover, a hardwood floor must also provide uniform response characteristics, regardless of the timing or location of an impacting object. In other words, the amount of surface area that is deflected upon impact should be minimal, so that deflection caused by one impacting object only minimally affects the floor's response to a nearby impacting object. Again, this is especially true for sports such as basketball, where the competitors are often quite close, and the floor undergoes numerous impacting forces within a relatively small surface area.

Thus, an inevitable problem arises, that of designing a hardwood floor system that provides significant deflection and shock absorption upon impact, in order to reduce injury, yet at the time confines, or attenuates the total surface area of deflection. Recognition of this problem is confirmed through standards established by the Otto Graf Institut, of Stuttgart, West Germany, in a series of test procedures which measure the critical performance characteristics of hardwood floor systems. The measured characteristics are: shock absorption; vertical deflection at the point of impact; attenuation of vertical deflection within a given surface area; ball reflection; sliding characteristics and rolling load behavior, and the test is identified as DIN #18032 part 2, as mentioned previously. To a large degree, the DIN test provides an indication of whether or not a particular floor system achieves an adequate solution for the above noted problems.

Several prior art patents disclose so-called shock absorbent floors. For example, Fritz U.S. Pat. No. 2,919,476 discloses a floor system designed to maximize the total surface area of deflection upon impact. However, a floor system of this type also causes unwanted deflection or "springiness" in areas that are adjacent to the point of impact. It would appear that Fritz would, upon impact, create huge dead spots or areas which cannot fully react to a second adjacent impact. As stated previously, for a sport such as basketball, the deflection caused by one player may adversely affect the play of another. Thus, the Fritz teaching to maximize the surface area of deflection upon impact runs counter to the acknowledged desire to attenuate impact deflection within a minimum surface area.

Stephenson U.S. Pat. No. 4,682,459 discloses a floor system having three layers of 4'×8' subflooring panels with the seams of the layers aligned in a specified pattern. The use of three subflooring layers to support the floorboards, along with spaced pads and an intermediate layer of cushion, is considered excessive, and results in an increase in the overall cost of material and installation for the floor system.

Despite these and other efforts, no known maple strip hardwood floor has met all the DIN standards for shock absorption, vertical deflection at the point of impact, a prescribed attenuation of deflection within a given surface area, ball reflection, sliding characteristics and rolling load behavior.

It is accordingly an object of this invention to provide an improved hardwood floor system that meets the six above-stated requirements of the DIN test.

It is another object of this invention to provide a hardwood, free-floating floor system that meets the six above-stated requirements of the DIN test, and at the same time provides a monolithic-like support system for the floorboards.

It is still another object of this invention to provide a hardwood free-floating floor system that meets the six above-stated requirements of the DIN test, but is relatively inexpensive compared to prior free floating floor systems.

This application describes herein further embodiments which are particularly directed to an economical floor system that provides a desirable degree of adherence to the performance characteristics of the DIN test, without necessarily meeting all of the strict criteria for each of these performance characteristics.

SUMMARY OF THE INVENTION

To these ends, one embodiment of a hardwood free-floating floor system according to the invention comprises a plurality of elongated maple floorboards supported by upper and lower subfloor layers of plywood panels, and a plurality of elastomeric pads secured to a bottom surface of the lower subfloor to support the floor system in a free floating manner above a base, with at least one kerfed surface in the group of surfaces including the floorboard bottom surface, the upper subfloor surfaces and the lower subfloor surfaces. The pads are deflectable, compressible, resilient and spaced uniformly, with one pad for approximately each square foot of base that is covered.

The combination of kerfs in at least one of the five above-mentioned surfaces, and a plurality of compressible deflectable pads results in a hardwood floor system that substantially meets most of the performance characteristics of the DIN test, but which does so in a more economical manner than the embodiment described in the parent application.

In another embodiment of the invention, kerfs are provided on both the top and bottom of one subfloor layer. In this embodiment, the top kerfs are preferably perpendicular to the bottom kerfs. Alternatively, the top and bottom kerfs may be oriented longitudinally with respect to the panels, with the top and bottom kerfs staggered across the width of the panel.

The pads are molded from an elastomeric material in order to provide resiliency, vibration dampening and shock absorption for the floor system. For each of three pad embodiments, the pads have a truncated shape with a truncated or flattened first end and a larger cross sectional cover at a second end. In a first embodiment, the pad comprises a single truncated conical shape. In the other embodiments, the pad has two elongated, parallel and connected trapezoidal sections. When in place, one end of each of the pads contacts the base and the other end contacts the bottom of the lower subfloor. The pads also have at least one internal hollow volume or space which decreases in cross-sectional area from the second end to the first end. This hollow volume is open at the second end. This second end opening, or openings, preferably has/have a cross sectional area larger than the cross sectional area of the first end, and there is no co-extensive area occupied by the first and second ends when the pad is unloaded. The volume of space occupied by this internal hollow space is substantially less than the volume occupied by the remainder of the elastomeric pad.

This hollow volume and the disposition of these surfaces enables the pad to deflect in the vertical direction immediately upon impact to the floorboards thereabove. After this initial deflection distorts the shape of the pad, additional impact force causes vertical compression between the ends. This structure not only provides a high degree of resiliency and shock absorption, but also an improvement in vibration dampening.

According to another aspect of this invention, an aspect particularly suited for use with a portable hardwood floor system, each pad includes a glide member located at its first end, and the first end contacts the base. The glide member enables the floor to slide with respect to the base, a feature which is particularly important with portable floor systems because it facilitates connection of the separate sections. The glide member may be of plastic or nylon construction, and is preferably molded as a tip into the pad. Alternately, the glide member may be secured to the flattened portion by an adhesive.

Compared to prior hardwood floor systems, this hardwood floor system of this invention provides a combination of elements that achieves vertical deflectability at the point of impact, but with a reduction in total surface area of deflection. Moreover, the kerfs in the panels enhance the overall dimensional stability of a panel-type hardwood floor system. This is due to minimization of internal stresses in the panels and because the kerfs allow room for the panels to expand due to moisture ontake. Additionally, this system substantially complies with most of the performance characteristics of the DIN test in an economical manner.

This floor system is relatively simple to manufacture. If the kerfs are to be formed in one of the subfloor layers, one surface of either the upper or lower subfloor panels is preferably cut with a saw to form a plurality of kerf lines extending diagonally at angles of about 45° with respect to the longitudinal edges of both sides of the panels, resulting in a criss-cross or diamond-shaped pattern. The lines are preferably spaced about six inches apart. Alternatively, the kerfs could extend along the longitudinal direction of the panel.

If the floorboards are kerfed, the kerf lines are cut transversely, or at an angle of about 90° with respect to the longitudinal floorboard edges, and are preferably spaced about every six inches. If desired, two of the three floor components may be kerfed. That is, the upper and lower subfloors may be kerfed, or the upper subfloor and the floorboards, or the lower subfloor and the floorboards. With respect to the subfloors, either the top or the bottom surface, or in one embodiment both surfaces, may be kerfed.

To install this floor system, one end of each of the pads is preferably stapled to the bottom surface of the lower subfloor, with one pad spaced about every square foot, and the lower subfloor panels are laid over the base. Alternatively, the pads can simply be placed on, or secured to the base with the proper spacing, and the lower subfloor panels laid thereover. The upper subfloor panels are laid over the lower subfloor, preferably with the joints of the two subfloor layers being staggered and overlapped. The two layers may be secured together by adhesive and/or by mechanical fasteners. Mechanical fasteners are then driven at an angle through the floorboards and into the upper subfloor to secure the floor system. Alternately, the mechanical fasteners can be driven through the floorboards, the upper subfloor and into the lower subfloor, with or without additional adhesive to secure the upper and lower subfloor layers.

In the installed floor, the floorboards should preferably intersect the kerfs at angles of about 45°-90°, regardless of whether the kerfs are longitudinal or diagonal with respect to the panel.

These and other features of the invention will be more readily appreciated in view of the following detailed description and the drawings in which:

DETAILED DESCRIPTION OF THE INVENTION

Figure 1:
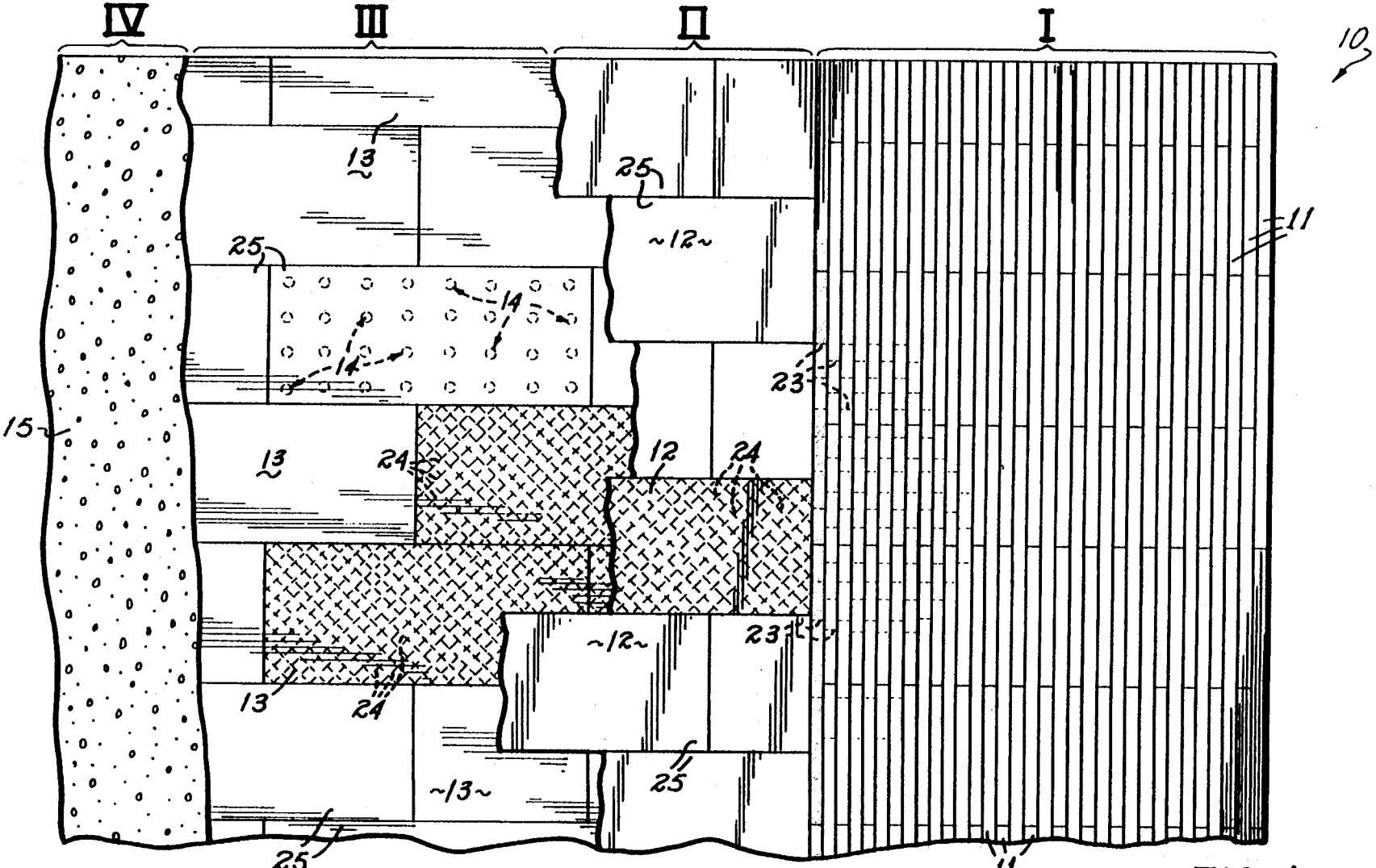
FIG. 1 is a broken away plan view, in four parts, of a hardwood floor system in accordance with the invention.

In order to understand the invention, it is important to understand how the Otto Graf Institut measures shock absorption, ball reflection, deflection at impact, attenuation of impact deflection, sliding characteristics and rolling load behavior, under the DIN test.

To test shock absorption, an apparatus referred to as the Berlin athlete is utilized. A 20 Kg object or missile is dropped upon the floor from a height of 55 mm. A transducer mounted in the missile measures the force upon impact. The measured force is compared to the same impact force measured for a drop from the same height upon a concrete floor. The shock absorption for a tested floor system is then given as a percentage of the force measured upon impact with concrete. To pass the shock absorption portion of the DIN test, a floor system must have a minimum shock absorption of 53%.

Another requirement for the DIN test relates to ball reflection. A basketball is electromagnetically dropped from a predetermined height, and the elapsed time between the first and second bounces is measured. Since elapsed time is directly proportional to vertical bounce height, the measured time between the first and second bounce on the test system is compared to the time measurement obtained when dropping the ball from the same height upon a concrete floor. The comparison is given as a percentage based on the measurement obtained for the concrete floor, and to pass this portion of the DIN test, the percentage must be 90% or greater.

In order to measure vertical deflection of the floor system at the point of impact, the DIN test utilizes an apparatus referred to as the Stuttgart athlete, which basically consists of a missile with a built in transducer for measuring impact force when dropped onto a floor. The missile is dropped from a height greater than 30 mm, but the mass of the missile and/or the drop height may be adjusted until an impact force of 1500 N is achieved. With the Stuttgart athlete set to provide this impact force, the missile is dropped onto the floor and vertical deflection is measured at the point of impact using a special sensor. To pass this part of the DIN test, a minimum vertical deflection of 2.3 mm under an impact force of 1500 N at the point of impact is required.

In order to measure the floor's ability to provide a desired amount of deflection attenuation within a specified surface area, vertical deflection under the same 1500 N force is measured at distances of 50 cm (20 inches) from the point of impact in directions transverse to the floorboards and in directions along the floorboards. For each of these four locations, a percentage is obtained based upon the ratio of vertical deflection at that location with respect to the measured vertical deflection at the point of impact. These percentages are then averaged to provide an indication of the total surface area affected by impact, or the floor system's ability to attenuate the impacting force within that surface area. To pass the DIN test, the average of the four percentages should be 15 percent or less.

The other two criteria for the DIN test relate to a floor system's sliding characteristics, or surface friction, and the floor system's behavior under a rolling load. Generally, for hardwood floors that are sealed with an oil modified urethane finish, the sliding characteristic portion of the DIN test will be met. In the rolling load test, a cart having a mass of 1500 N and wheels of a specified diameter and width is rolled over the floor system. During rolling of the cart, the floor system is closely scrutinized for any cracks or damage in the floorboards or finish, or any vertical deflection. This test assesses the floor system's ability to withstand substantial load at a point, as for instance caused by rolling bleachers that are normally collapsed against a wall.

In short, to pass the DIN test, a hardwood floor system must be able to: absorb a prescribed amount of shock upon impact, compared to concrete; provide a minimum amount of ball reflection, compared to concrete; vertically deflect a minimum amount at the point of impact under a prescribed force of 1500 N; and attenuate this vertical deflection by a desired amount within a prescribed surface area. The hardwood floor system depicted in the accompanying drawings meets all of these difficult standards established by the DIN test.

FIG. 1 shows, in broken away portions designated I, II, III and IV, a free floating hardwood floor system 10 supported above a base in accordance with a preferred embodiment of the invention. In portion I, a plurality of parallel rows of hardwood maple floorboards 11 laid end to end constitute the playing surface provided by the floor system 10. The floorboards are laid end to end in a plurality of parallel rows and are secured to the underlying support layer by mechanical fasteners. The floorboards are typically random length (12" to 8') either 1½" or 2¼" in width, and have a thickness of either 25/32 of an inch, or 33/32 of an inch. Preferably, the floorboards in each row are staggered with respect to those in adjacent rows, for increased horizontal stability. The relative vertical relationship between adjacent rows of floorboards is maintained by providing a tongue on one side and a mating groove on the other side of each floorboard. The floorboard tongues from one row reside within the floorboard grooves of the adjacent row. If desired, the floorboards may be sealed and finished with an oil-modified urethane compound.

Portion II shows an upper subfloor 12 comprising panels residing beneath the floorboards 11, with the underneath kerf pattern shown in broken lines under one panel. Alternatively, the upper subfloor may have longitudinal kerfs, and the subfloor 12 may be oriented diagonal to the floorboards. Portion III shows a lower subfloor 13 comprising panels residing beneath the upper subfloor 12, with the underneath kerf pattern shown in broken lines under one panel. Alternatively, the kerfs in the lower subfloor may also be oriented longitudinally. Portion IV shows a base, or substrate 15, that supports the entire free-floating floor system 10.

Preferably the upper subfloor layer 12, and the underlying subfloor layer 13 comprise a plurality of 4'×4' or 4'×8' wooden panels having a thickness of about ½". If desired, the panels may be of other suitable supportive material. For overall floor stability, it is preferable that the edges of the upper and lower subfloor panels be staggered and overlapped.

A plurality of elastomeric, deflectable pads 14 support the floor system 10 above the base 15 in a free floating manner, as shown in FIG. 1 with respect to one of the lower subfloor 13 panels. Preferably, the pads 14 are spaced about one every square foot, and are secured to the bottom of the lower subfloor 13.

Figure 2:
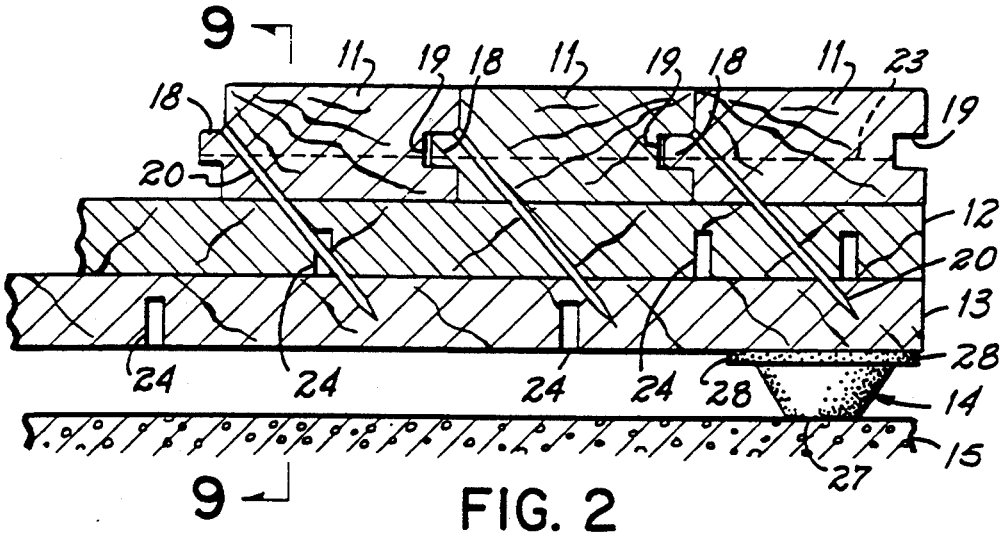
FIG. 2 is a cross-sectional view of a portion of a hardwood floor system in accordance with the invention.

As shown in FIG. 2, the relative vertical relationship between adjacent rows of floorboards 11 is maintained by a tongue 18 located on one side and a mating groove 19 on the other side of each floorboard 11. Adjacent the tongue 18, mechanical fasteners 20 may be driven into the floorboards 11, through the upper subfloor 12 and into the lower subfloor 13. It is typical in the industry to staple or nail these mechanical fasteners 20 into the floorboards at a predetermined angle of about 45°, as shown in FIG. 2. Alternately, or additionally, adhesive (not shown) may also be used in securing the upper subfloor 12 panels to the lower subfloor 13 panels. If adhesive is used between subfloor 12 and subfloor 13, the fasteners 20 need only be driven into upper subfloor 12.

In another embodiment of the invention, the floor system 10 is secured in a manner disclosed in Applicant's co-pending patent application Ser. No. 162,088, which is expressly incorporated herein by reference in its entirety. According to this system, nails are driven into the floorboards at an angle, through the upper subfloor and into a nail clinching strip retained in place in a groove in the bottom surface of the upper subfloor. The upper and lower subfloors are secured together by adhesive and fasteners.

Figure 3:
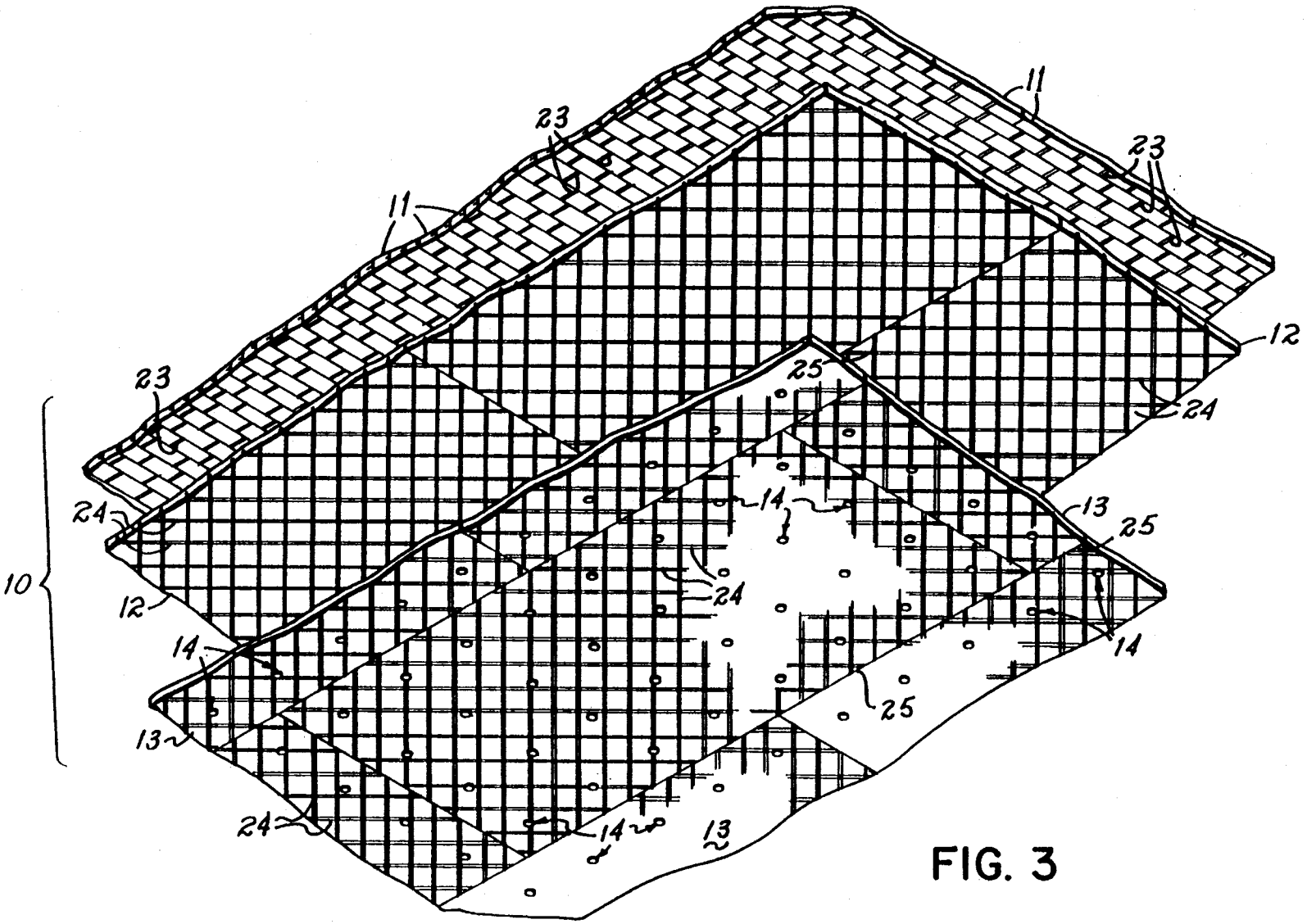
FIG. 3 is an exploded view of a portion of a hardwood floor system in accordance with the invention.
Figure 9:
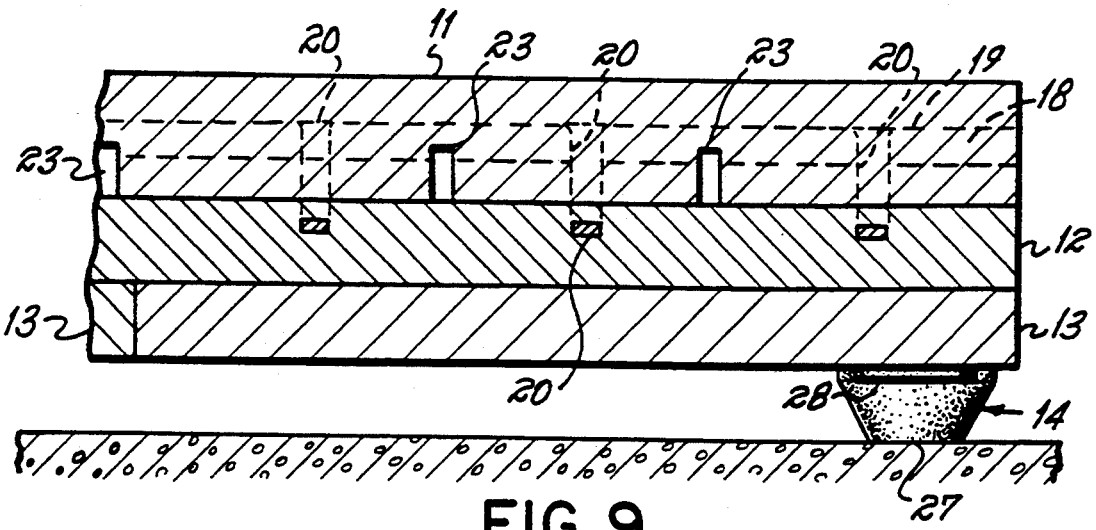
FIG. 9 is a cross sectional view taken along lines 9—9 of FIG. 2, showing a hardwood floor system modified from the system shown in FIG. 2 in that kerfs are provided in the floorboards, in accordance with still another embodiment of this invention.

If the floorboards 11 are kerfed, the kerfs 23 are preferably cut transversely into the bottom surfaces, as shown in FIGS. 3 and 9. Preferably, the kerfs 23 are spaced about every 8", and have a depth ranging to from about one half to one third of the thickness of the floorboards, although the depth and spacing could be varied. The kerfs 23 can be cut into the floorboards with a standard saw blade, resulting in a width of about ⅛ of an inch. Preferably, the depth of the kerfs 23 extends in the range of about ¼ to ¾ the thickness of the floorboards 11. There is no particular spacing requirement between the relative locations of the kerfs 23 of one floorboard 11 with respect to the kerfs 23 of adjacent floorboards.

If one of the subfloors is kerfed, each of the panels of either the upper subfloor 12 or the lower subfloor 13 has a kerf pattern 24 cut into one of its surfaces. As shown in FIG. 3 with respect to both subfloors, FIG. 7 with respect to the lower subfloor 13, and FIG. 8 with respect to subfloor 14, the kerfs preferably form a criss-cross pattern 24 that extends diagonally at an angle of about 45° from the longitudinal edges 25 of each of the subfloor panels, with adjacent parallel kerfs preferably spaced about 6" apart. Alternatively, the criss-cross may have lines that are at a 90° angle to the edges, or any other angle, so long as a plurality of kerfed squares is produced. The kerfs may be cut with a standard saw blade, resulting in kerfs having a width of about an ⅛ of an inch and a depth of about ⅓ the panel thickness. Again, the depth and spacing of the kerf patterns could be varied somewhat, if desired. There is no particular requirement that the kerf pattern 24 of any one of the panels be aligned in any specific manner with respect to the kerf pattern 24 of an adjacent panel, or the above residing or below residing panel if multiple components are to be kerfed.

Figure 4:
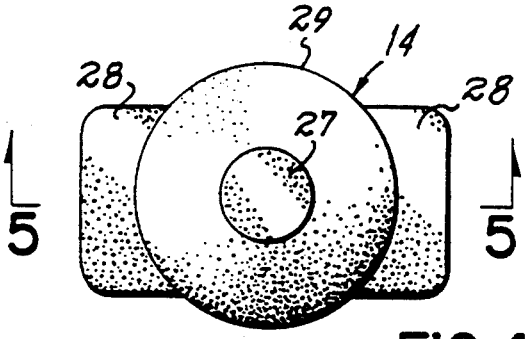
FIG. 4 is a bottom view of an elastomeric compressible pad used in a hardwood floor system in accordance with the invention.
Figure 5:
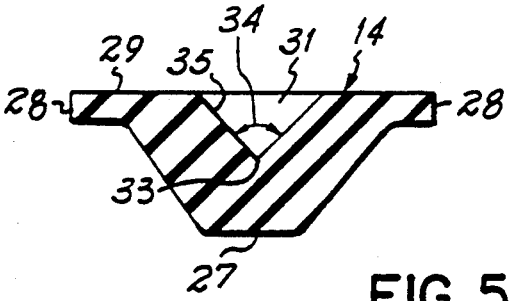
FIG. 5 is a cross-sectional view taken along lines 5–5 of FIG. 4.

FIGS. 4 and 5 show an elastomeric pad 14 that supports the floor system 10 over the base 15. Preferably, these pads 14 are made of ethylene propylene rubber with a hardness ranging from about 45 to 80 durometer on the Shore A scale, although any other elastomeric or compressible, moldable material would be sufficient. Ethylene propylene is not susceptible to excessive degradation over a period of time. In one preferred embodiment, the pads 14 have an inverted conical shape, with a truncated, downwardly directed, flattened first end 27 and a larger cross sectional cover, or second end 29. The first and second ends contact the top of the base 15 and the bottom of the lower subfloor 13, respectively, although this would be reversed if the pads 14 are inverted. Preferably, opposing tabs 28 extend in opposite directions from the second end cover 29, the tabs 28 being securable to the lower subfloor 13 by staples (not shown).

Each of the pads 14 has an internal hollow volume 31 located at second end 29. The hollow volume 31 has a cross sectional area that decreases from second end 29 to first end 27. Preferably, as shown in FIG. 5, this cross sectional area at second end 29 is greater than the area of first end 27. Volume 31 occupies less space than the remainder of the pad 14. The pad 14 shown in FIG. 5 occupies about 0.645 cubic inches, while volume 31 occupies about 0.043 cubic inches, or about 6.7% of the pad 14 volume. While it is preferable that this volume ratio be about 5% to 15%, it may extend up to 30% or higher depending upon the hardness of the material used to form the pad 14.

Preferably, as shown in FIG. 5, the hollow volume 31 is conical in shape, with a downwardly directed apex 33 located at the intersection of interior sidewalls 35, which define an angle 34 that is preferably about 110°. It is noted that there is no coextensive contact area between first 27 and second 29 ends. Moreover, there exists no solid or uninterrupted vertical line of material extending from first end 27 to second end 29 when in an unloaded condition. This combination of features insures that the pads 14 deflect initially upon impact to the floorboards 11 above, with no initial compression. Thereafter, deflection distorts the shape of the pad 14 so that there is some portion of the pad 14 where a solid vertical line of material extends between front and second ends. This material must now be compressed in order to provide additional vertical deflection at the top surfaces of the floorboards 11 upon impact thereto. Due to the combination of deflection and compression, and in addition, the elastomeric material used, the pad 14 provides not only a high degree of deflection and resiliency for the floor system 10, but the pads 14 also provide a high degree of vibration dampening that cannot be achieved with many other so-called "high deflection" hardwood floors.

As stated previously, it is preferred that the pads 14 be unattached to the base 15 so that the floor system 10 floats freely. However, if desired, the floor system 10 may be anchored to the base 15, either by applying adhesive between the pads 14 and the base 15 or providing other means of restricting horizontal and vertical movement by the pads 14 with respect to the base.

Figure 7:
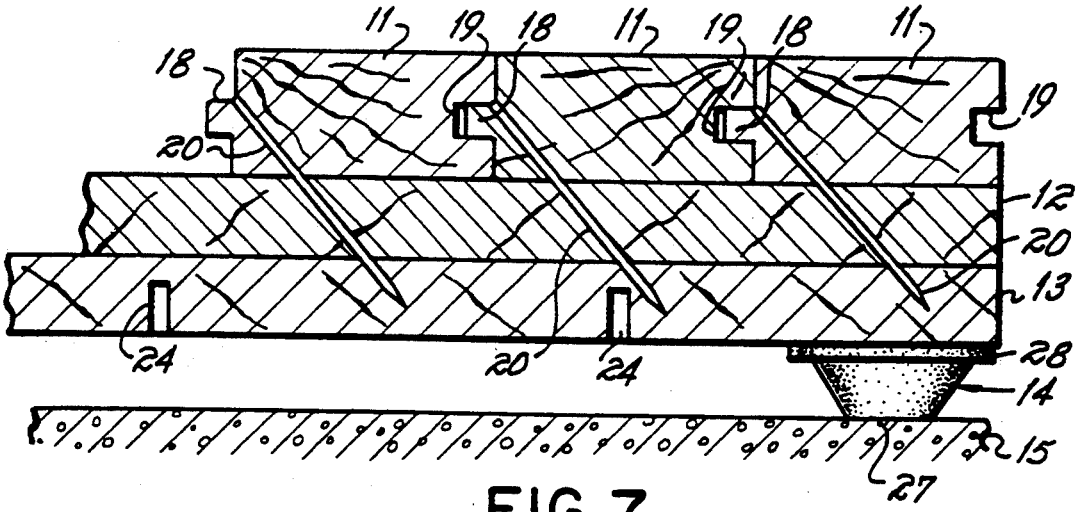
FIG. 7 is a cross sectional view, similar to FIG. 2, showing a hardwood floor system with kerfs in a lower subfloor, in accordance with one embodiment of the invention.
Figure 8:
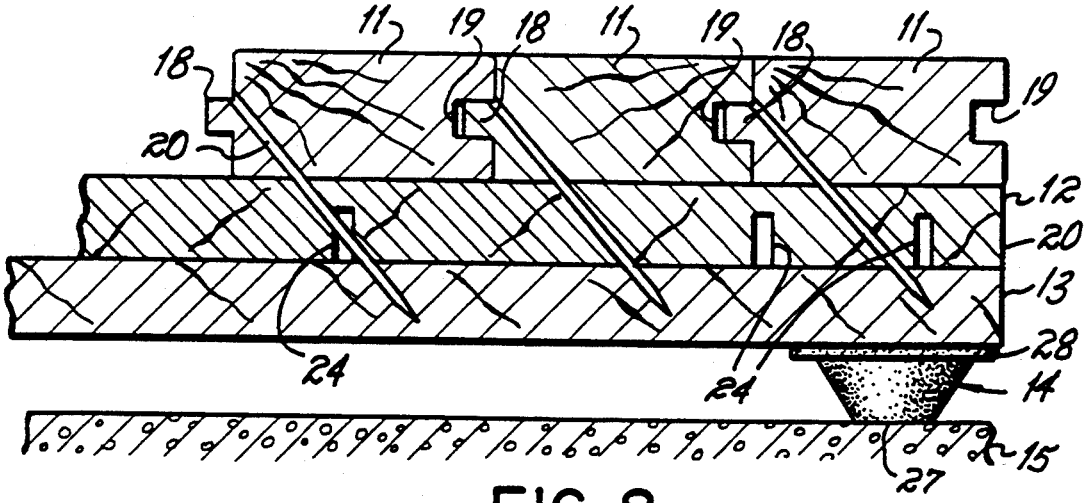
FIG. 8 is a cross sectional view, similar to FIG. 2, showing a hardwood floor system with kerfs in an upper subfloor, in accordance with another embodiment of this invention.

FIGS. 7, 8 and 9 show alternative embodiments of the invention. FIG. 7 shows kerfs 24 in the bottom surface of the lower subfloor 13. FIG. 8 shows kerfs 24 in the bottom surface of the upper subfloor 12. FIG. 9 shows kerfs 23 in the floorboards 11. As stated previously, the kerfs 24 in the upper subfloor 12 and lower subfloor 13 may form a diagonal pattern.

Figure 10:
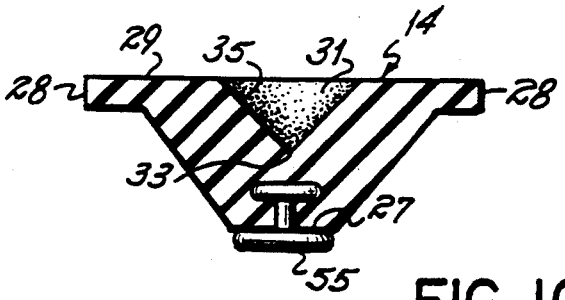
FIG. 10 is a cross sectional view, similar to FIG. 5, of a pad which incorporates a glide member feature of the invention.
Figure 11:
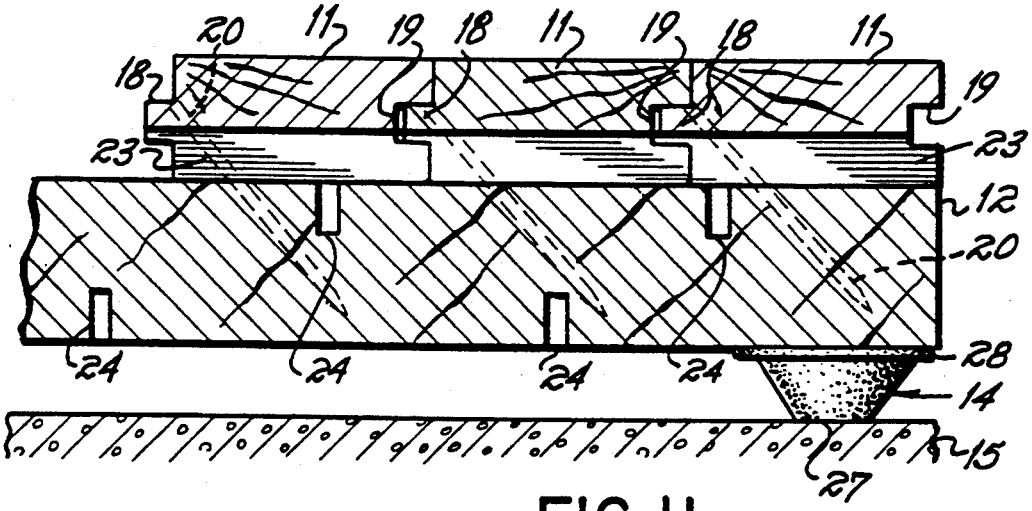
FIG. 11 is a cross sectional view, similar to FIG. 2, of a hardwood floor system with one subfloor, in accordance with another aspect of the invention.

FIG. 10 shows another aspect of the invention that is advantageous when the floor system 10 is used in a free-floating manner, particularly when portability is required. For a portable floor, a plurality of portable, interconnectable 4'×8' sections or 4'×4' sections are locked together to form a floor system 10 as shown in FIG. 1. Each section includes floorboards 11, an upper subfloor 12, a lower subfloor 13 and a plurality of slidable pads 14 supporting the floor system 10 above the base 15, preferably with one surface of the upper subfloor 12 surfaces, the lower subfloor 13 surfaces and the floorboard 11 bottom surfaces being kerfed. Each of the pads 14 is rendered slidable with respect to the base 15 by the addition of a glide member 55 located at first end 27, as shown in FIG. 9. The glide member 55 is preferably a tip molded into pad 14, although it may be adhered with a glue. The glide member 55 is made out of a material such as plastic or nylon, or any other durable material with a similarly low coefficient of friction. Typically, the sections must be moved laterally on base 15 in order to interconnect the sections to form the floor system 10.

Figure 12:
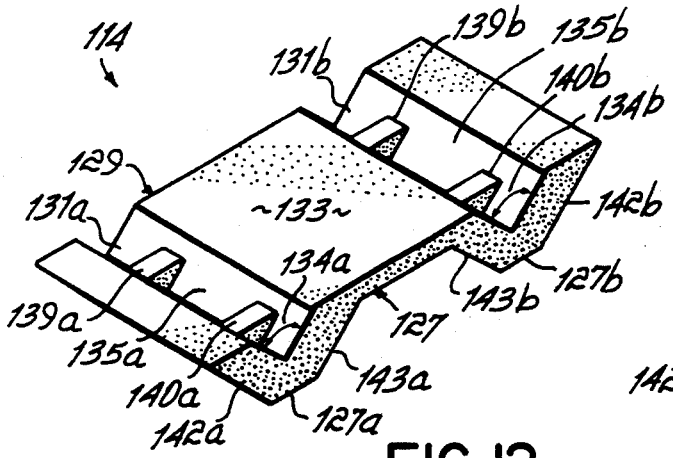
FIG. 12 is a perspective view of an alternative embodiment of a compressible pad used in a free floating hardwood floor system in accordance with the invention.
Figure 13:
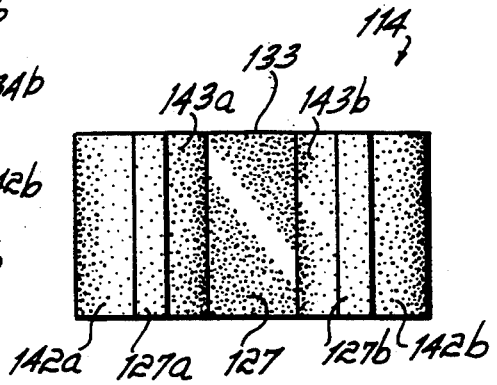
FIG. 13 is a plan view of a first end of the pad shown in FIG. 12.

FIGS. 12 and 13 show an alternative embodiment of a pad 114 used in conjunction with the floor system 10. Compared to pad 14 which has one truncated conical shape, pad 114 has two elongated and parallel trapezoidal shapes. This alternative embodiment includes a first end 127 with a pair of parallel, spaced flat portions **127*a* and 127*b* and a second end 129 with a pair of parallel, spaced hollow volumes 131*a* and 131*b*. Each of these hollow volumes, 131*a* and 131*b*, has a cross sectional area that decreases from second end 129 to first end 127. Moreover, each of these cross sectional areas at second end 129 is greater than the respective flat portion 127*a* and 127*b* at first end 127. The two volumes 131*a* and 131*b* occupy less space than the remainder of the pad 114**.

Pad 114 preferably occupies about 0.671 cubic inches, while the volumes **131*a* and 131*b*** occupy about 0.070 cubic inches, or about 10.45% of the pad volume. As with the first embodiment, it is preferable that this volume ratio be about 5% to 15%, though it may extend up to about 30% depending upon the hardness of the material.

As shown in FIG. 12, pad 114 looks like two elongated, parallel trapezoids, with a flat connector portion 133 extending therebetween at second end 131. Interior-angled sidewalls **135*a* of pad 114 define the apex of hollow volume 131*a*, with a preferable angle 134*a* of about 110° defined therebetween. The pad 114 also has two parallel supports 139*a* and 140 which extend perpendicularly across hollow volume 131*a*. Adjacent flat portion 127*a*, the pad 114 has two exterior walls 142*a* and 143*a***.

Similarly, the other half of the pad 114 has identical interior sidewalls **135*b*, angle 134*b*, supports 139*b* and 140*b* and exterior sidewalls 142*b* and 143*b***.

Figure 14:
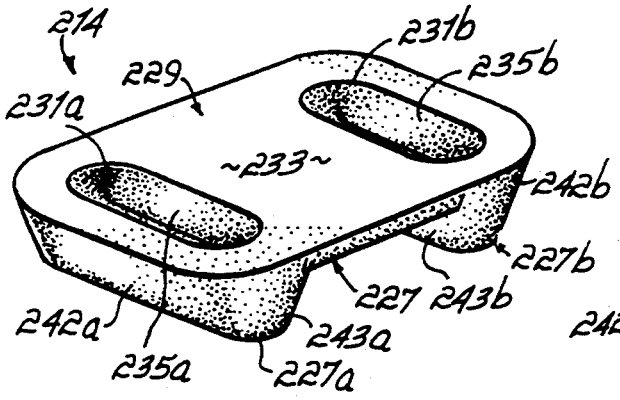
FIG. 14 is a perspective view of another alternative embodiment of an elastomeric pad used in a free floating hardwood floor system in accordance with the invention.
Figure 15:
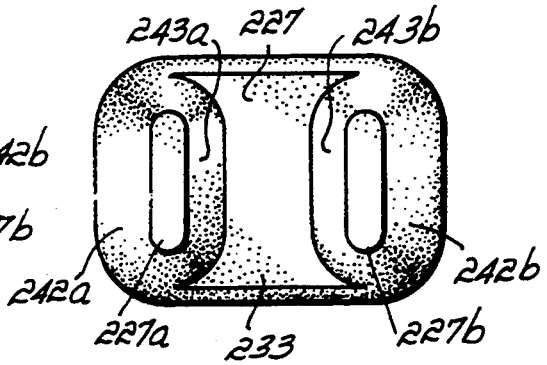
FIG. 15 is a plan view of a first end of the pad shown in FIG. 14.

FIG. 14 shows another embodiment of a pad 214 used in conjunction with this floor system 10. This pad 214 is similar to pad 114, having a first end 227 with two flat portions **227*a* and 227*b* and a second end 229 with two hollow volumes, 231*a* and 231*b*, which are defined by interior-angled sidewalls 235*b*. While trapezoidal in transverse cross section, the pad 214 has hollow volumes 231*a* and 231*b*** which are rounded off at their ends.

A connecting portion 233 connects the two parallel trapezoidal sections. Exterior sidewalls 242*a* and 243*a* extend from flat portion 227*a*, and exterior sidewalls 242*b* and 243*b* extend from flat portion 227*b*.

Like pad 14 and pad 114, pad 214 has no line of continuous material from first end 227 to second end 229, the hollow volumes 231*a* and 231*b* decrease in cross sectional area from second end 229 to first end 227, and the hollow volumes are greater in cross sectional surface area at second end 229 than flat portions 227*a* and 227*b*, respectively. The pad 214 preferably occupies about 0.633 cubic inches, and the hollow volumes 231*a* and 231*b* preferably occupy about 0.059 cubic inches, or about 9.4% of the pad 214 volume.

Like the pad 14 described previously, pad 114 and pad 214 are molded out of ethylene propylene rubber with a hardness ranging from about 45 to 80 durometer on the Shore A scale. Applicant has learned that a value of 50 durometer works particularly well for a floor system used primarily for aerobics, while a value of 60 durometer works particularly well for a floor system used primarily for competitive athletic events.

The pads 114 and pads 214 are preferably spaced on 16" centers. Both pad 114 and pad 214 provide a high degree of resiliency at a relatively low profile, i.e. preferably about 7/16". Like pad 14, pad 114 and pad 214 provide sufficient deflectability and compressibility to enable the floor system 10 to pass the DIN standard. Moreover, due to the low profile, pad 114 or pad 214 may be used in a floor system supported by sleeper channels, as described in U.S. Pat. No. 4,856,250 which is currently owned by applicant.

In a variation of either pad 114 or pad 214, instead of being parallel and spaced apart, the trapezoidal shapes could be extended circularly and connected around the flat portion 133 and 233, respectively. All of these modification facilitate installation by only requiring one mechanical fastener.

Figure 6:
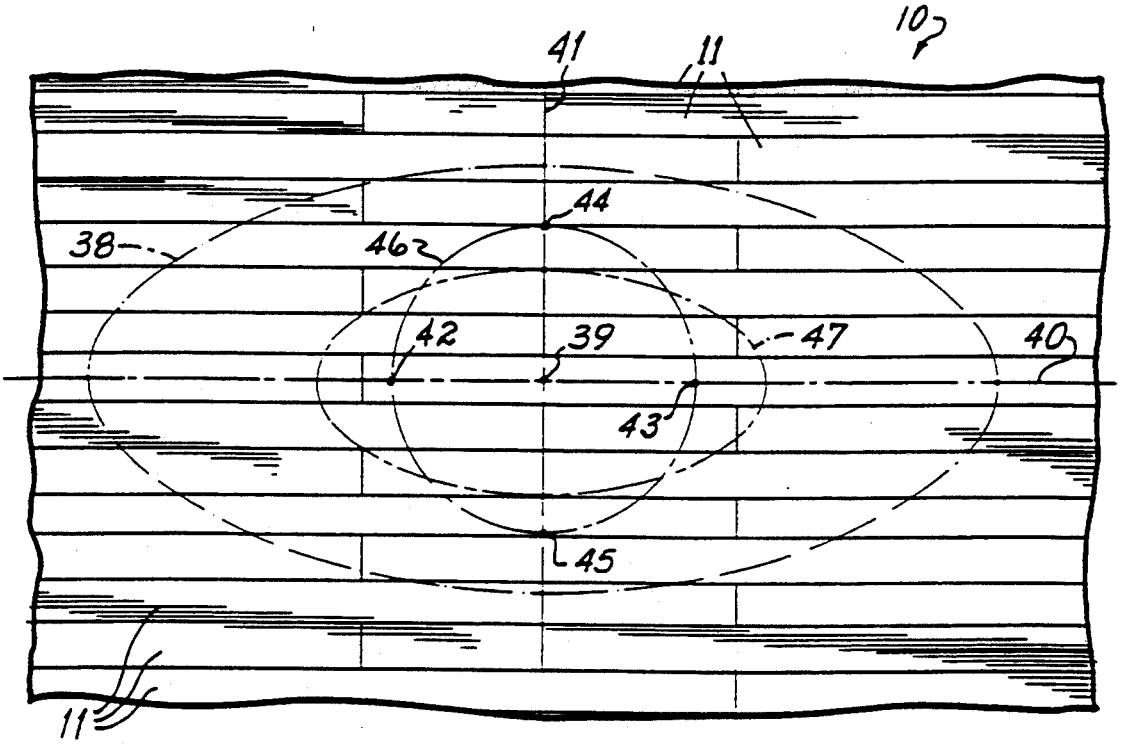
FIG. 6 is a plan view of a hardwood floor system illustrating various deflection patterns as will be discussed.

In order to further illustrate the advantages of the various embodiments of this invention, an understanding of the typical deflection patterns of prior hardwood flooring systems will be helpful. FIG. 6 illustrates such deflection in part. In particular, oval pattern 38 typifies the general shape of the surface area that is vertically deflected when a prior hardwood floor system is contacted by an object at a point of impact 39. It will be appreciated the major axis of the oval pattern of deflection generally occurs along the longitudinal extension of the floorboards.

As described previously, in order to assess a floor's ability to deflect downwardly at the point of impact, and its ability to attenuate this downward deflection, it is necessary to measure deflection at the point of impact and at locations spaced away from the point of impact. Thus, the DIN test includes measuring deflection at the point of impact 39 and at four other locations with respect to the point of impact 39. Two of these locations, designated 42 and 43, lie on the major axis 40, and are located 50 cm (about 20 inches) from the point of impact 39, on opposite sides thereof. The other two locations, designated 44 and 45, lie along a transverse axis 41, and are located a distance of 50 cm from the point of impact 39 on opposite sides thereof. The deflection measurements taken at locations 42 and 43 are averaged to obtain a value, and the average is used in calculating a percentage of deflection with respect to the measured deflection at the point of impact 39. This value provides an indication of the floor's ability to attenuate the deflection longitudinally or along the major axis. Similarly, the deflection measurements from locations 44 and 45 are averaged and compared to the deflection at point of impact 39 to obtain a value indicative of the floor's ability to attenuate deflection in the transverse direction. Both of the values are then averaged to obtain an overall percentage that is representative of the total surface area of the floor that is affected by impact.

Ideally, to meet both the deflection and attenuation criteria for the DIN test, a hardwood floor system should deflect a minimum of 2.3 mm, at the point of impact, and attenuate at least 85% of this deflection within the circular pattern shown in FIG. 6. In other words, the deflection measurements taken at locations 42, 43, 44 and 45, when averaged, should be less than or equal to 15% of the deflection measured at point of impact 39.

It is generally recognized that many floor systems have some variation in deflection characteristics depending upon the relative location of the point of impact with respect to the underlying layers. Therefore, in order to obtain an accurate measurement of the resiliency of a floor system, the testing procedure should be carried out several times, and the results averaged. For the floor system of this invention, in performing DIN #18032 part 2, six different points of impact 39 were chosen, and the obtained values were averaged to determine whether or not the floor system met the minimum resiliency requirements. These six different points of impact 39 were chosen so as to incorporate into the final result some measure of the resilient and non-resilient extremes caused by each layer of the floor system.

For instance, the first impact point chosen was directly above the location of a pad 14. A second point was chosen midway between two adjacent pads 14, based upon the assumption that measurements taken at these two points would reflect the greatest discrepancy in floor system resiliency caused by the pads 14 alone. A third point of impact was chosen at a location such that, from a vertical perspective, a seam from a panel of the lower subfloor intersects a seam from a panel of the upper subfloor. A fourth point of impact was chosen where there are no vertically aligned upper and lower subfloor seams. A fifth point of impact was chosen at the seam formed between two of the maple floorboards laid end to end, and a sixth point of impact was chosen midway between the two longitudinal edges of one maple floorboard. By using these six different points of impact, and averaging the obtained values for each one, the final values will provide the most accurate assessment of the overall resiliency of the floor system 10.

The following table shows the averaged values obtained in carrying out DIN #8032 part 2 on a hardwood floor system according to an embodiment of the invention described in the parent application. The measured values indicated that the deflection pattern for the floor system approximated an oval shaped pattern 47, as shown in FIG. 6, which is much smaller than the typical oval pattern deflection area of prior floors as illustrated by pattern 38 in FIG. 6. The measured values also indicate that this floor system 10 surpassed the DIN test requirements for shock absorption, vertical deflection at the point of impact, deflection attenuation, sliding characteristics, rolling load behavior, and ball reflection. It is noted that no other known maple strip hardwood floor system is capable of meeting these six requirements of the DIN test. This floor system constitutes a significant improvement over prior hardwood floor systems, and represents a major step toward injury reduction and highly consistent performance characteristics in hardwood floors.

TABLE

| | Measured Parameter | Test Result | DIN Standard |
|---|---|---|---|
| 1) | Shock absorption | 69.6% | min 53% |
| 2) | Vertical deflection impact | 2.90 mm | min 2.3 mm |
| 3) | Deflection attenuation | 14.5% | max 15% |
| 4) | Ball reflection | 93.3% | min 90% |
| 5) | Sliding Characteristics | 0.61 | min 0.5 max 0.7 |
| 6) | Rolling Load Behavior | 1500N | 1500N |

The results of the DIN test for this hardwood floor system are contained in a report by the Otto Graf Institut entitled "Suitability Test Report," which was expressly incorporated into the parent application.

While it is not known with certainty whether all of the embodiments of the present invention depicted in FIGS. 7–15 would meet each of the strict performance characteristics established by the DIN test, it is known that floor systems which utilize the pad of this invention, each of the three embodiments, do meet the DIN criteria. Moreover, it is also known that, for a hardwood floor system with a panel type subfloor, the combination of kerfs and a plurality of pads results in a floor system which fares reasonably well under the shock absorption, vertical deflection at impact and deflection attenuation aspects of the DIN test. This is not true for prior panel-type hardwood floors with "high deflection" capability, but relatively poor deflection attenuation. Compared to the embodiment claimed in the parent application, the present invention provides a desirable degree of resiliency at a lower cost, thereby increasing the availability of an improved hardwood floor system to a larger number of users.

While a preferred embodiment of a resilient free floating floor system in accordance with this invention has been described, it is to be understood that the invention is not limited thereby and that in light of the present disclosure, various other alternative embodiments will be apparent to one of ordinary skill in the art without departing from the scope of the invention. For example, the kerf shapes, spacing disposition, depths and relative orientation might be adjusted and still provide a system that meets or substantially complies with the DIN standards. Other modifications could also be made. Accordingly, applicant intends to be bound only by the following claims.

I claim:

1. A hardwood floor system comprising:

a plurality of portable sections, each said section including means adapted for operatively interconnecting said sections together to form an interconnected floor system;

a plurality of resilient, shock absorbing and vibration dampening pads attached to a bottom surface of each said section for supporting said section above a base, and a plurality of glide members, each said glide member located below one of said pads and being substantially non-compressible under normal floor loading conditions, the glide members having a lower coefficient of friction than the pads, thereby to facilitate interconnection of said sections in order to form said floor system.

2. The floor system of claim 1 wherein each of said pads has an inverted and truncated conical shape, with a flattened lower end below which said respective glide member extends to ground support said floor section above said base.

3. The floor system of claim 2 wherein said glide member is a tip which is molded into a respective pad.

4. A hardwood floor system comprising:

a lower subfloor disposed above a base and having top and bottom surfaces;

an upper subfloor disposed above said lower subfloor and having top and bottom surfaces;

a wearing surface consisting of a plurality of floorboards arranged end to end in parallel rows along the entire base, with staggered joints between the ends of the floorboards of adjacent rows and each floorboard in a row being interconnected by a tongue and a groove with floorboards of adjacent rows, the floorboards having a predetermined thickness and top and bottom surfaces and downwardly directed hollow kerfs in said bottom surfaces, the kerfs oriented at angles intersecting the longitudinal direction of the floorboards, the wearing surface secured to a top surface of the upper subfloor; and a plurality of pads for supporting the subfloors and floorboards in spaced relation above a base whereby, upon impact to the floorboards at an impact point, the kerfs promote attenuation of deflection within a reduced surface area centered on the point of impact.

5. The floor system of claim 4 wherein said kerfs extend in a direction substantially perpendicular to the longitudinal edges of the floorboards.

6. The floor system of claim 4 wherein one surface of said lower subfloor top and bottom surfaces and said upper subfloor top and bottom surfaces also has kerfs formed therein.

7. The floor system of claim 6 wherein at least two surfaces of said lower subfloor top and bottom surfaces and said upper subfloor top and bottom surfaces also have kerfs formed therein.

8. A hardwood floor system comprising:

at least one subfloor panel disposed above a base and having top and bottom surfaces;

a wearing surface consisting of a plurality of floorboards arranged end to end in parallel rows along the entire base, with staggered joints between the ends of the floorboards of adjacent rows and each floorboard in a row being interconnected by a tongue and a groove with floorboards of adjacent rows, the floorboards having a predetermined thickness and top and bottom surfaces, the floorboards secured to at least one subfloor panel and having hollow downwardly directed kerfs in said bottom surfaces, the kerfs oriented at angles intersecting the longitudinal direction of the floorboards; and a plurality of pads below the panel for providing resilient, shock absorbing and vibration dampening support for said subfloor panel and said floorboards in spaced relation above a base whereby, upon impact to the floorboards at an impact point, the kerfs promote attenuation of deflection within a reduced surface area centered on the point of impact.

9. A hardwood floor system comprising:

a lower subfloor disposed above a base and having top and bottom surfaces;

an upper subfloor disposed above said lower subfloor and having top and bottom surfaces;

a plurality of floorboards secured to said upper subfloor, the floorboards arranged end to end in parallel rows along the entire base, with staggered joints between the ends of the floorboards of adjacent rows and each floorboard in a row being interconnected by a tongue and a groove with floorboards of adjacent rows, the floorboards having top and bottom surfaces;

a plurality of pads for supporting the subfloors and floorboards in spaced relation above a base, each of the pads having first and second ends of unequal surface area, one of the first and second ends residing in contact with the base and the other of the ends residing in contact with the bottom surface of the lower subfloor, each of the pads having at least one hollow volume located adjacent one of said first and second ends; and wherein kerfs are formed in at least one surface of the group of surfaces including said lower subfloor top and bottom surfaces, said upper subfloor top and bottom surfaces and said floorboard bottom surface and whereby, upon impact to the floorboards at an impact point, the kerfs promote attenuation of deflection within a reduced surface area centered on the point of impact.

10. The floor system of claim 9 wherein at least two surfaces of said lower subfloor top and bottom surfaces and said upper subfloor top and bottom surfaces also have kerfs formed therein.

11. A hardwood floor system comprising:

at least one subfloor panel disposed above a base and having top and bottom surfaces;

a plurality of floorboards disposed above said subfloor panel and arranged end to end in parallel rows along the entire base, with staggered joints between the ends of the floorboards of adjacent rows and each floorboard in a row being interconnected by a tongue and a groove with floorboards of adjacent rows, the floorboards having top and bottom surfaces;

a plurality of pads below the subfloor panel for providing resilient, shock absorbing and vibration dampening support for said subfloor and said floorboards above a base, each of the pads having first and second ends of unequal surface area, one of the first and second ends residing in contact with the base and the other of the ends residing in contact with the bottom surface of the panel, each of the pads having at least one hollow volume located adjacent one of said first and second ends; and wherein kerfs are formed in at least one surface of the group of surfaces including said subfloor panel top and bottom surfaces and said floorboard bottom surface and whereby, upon impact to the floorboards at an impact point, the kerfs promote attenuation of deflection within a reduced surface area centered on the point of impact.

12. A hardwood floor system comprising:

a subfloor disposed above a base and having top and bottom surfaces;

a wearing surface comprising a plurality of floorboards arranged end to end in parallel rows along the entire base, with staggered joints between the ends of the floorboards of adjacent rows and each floorboard in a row being interconnected by a tongue and a groove with floorboards of adjacent rows, the floorboards having a predetermined thickness and top and bottom surfaces, the floorboards secured to the subfloor and having downwardly directed kerfs in said bottom surfaces, the kerfs oriented at angles intersecting the longitudinal direction of the floorboards; and a plurality of pads located below the subfloor for providing resilient, shock absorbing and vibration dampening support for said subfloor and said floorboards in spaced relation above the base whereby, upon impact to the floorboards at an impact point, the kerfs promote attenuation of deflection within a reduced surface area centered on the point of impact.

13. The hardwood floor system of claim 12 wherein the subfloor comprises one layer of a plurality of panels.

14. The hardwood floor system of claim 12 wherein the subfloor comprises two layers, and at least one of said layers comprises a plurality of panels.

15. The hardwood floor system of claim 14 wherein each of said subfloor layers comprises a plurality of panels.

16. A hardwood floor system for covering a base comprising:

a floor structure having a wearing surface comprising a plurality of floorboards arranged end to end in parallel rows along the entire base, with staggered joints between the ends of the floorboards of adjacent rows and each floorboard in a row being interconnected by a tongue and a groove with floorboards of adjacent rows, the floorboards having a predetermined thickness and top and bottom surfaces, the floorboards having downwardly directed kerfs in said bottom surfaces, the kerfs oriented at angles intersecting the longitudinal direction of the floorboards; and a plurality of pads located below the floor structure for providing resilient, shock absorbing and vibration dampening support for said floor structure in spaced relation above the base whereby, upon impact to the floorboards at an impact point, the kerfs promote attenuation of deflection within a reduced surface area centered on the point of impact.

17. The hardwood floor system of claim 16 wherein the floorboards comprise wood.

18. The hardwood floor system of claim 16 wherein the floor system is free-floating above the base.

* * * * *